US005146205A

United States Patent [19]

Keifer et al.

[11] Patent Number: 5,146,205

[45] Date of Patent: Sep. 8, 1992

[54] SECURITY AND DISPLAY SYSTEM

[75] Inventors: Terry A. Keifer; Larry R. Yeager, both of Reading, Pa.

[73] Assignee: Protex International Corp., Bohemia, N.Y.

[21] Appl. No.: 676,424

[22] Filed: Mar. 28, 1991

[51] Int. Cl.[5] ..... G08B 13/14

[52] U.S. Cl. ..... 340/568; 340/572; 340/540

[58] Field of Search ..... 340/568, 572, 665, 668, 340/540; 81/436, 460

[56] References Cited

U.S. PATENT DOCUMENTS

| | | | |
|---|---|---|---|
| 3,253,270 | 5/1966 | Downer | 340/568 |
| 4,211,128 | 7/1980 | Plumer | 81/436 |
| 4,598,827 | 7/1986 | Keifer | 211/4 |

OTHER PUBLICATIONS

Protex Security Systems, Inc., "Secure-Cam", Nov. 1987.

*Primary Examiner*—Jin F. Ng
*Assistant Examiner*—Christine K. Oda
*Attorney, Agent, or Firm*—Eugene E. Renz, Jr.

[57] ABSTRACT

A security and display system for use with a retail item having a threaded bore. The system includes a base for supporting the retail item. The base is fixedly mounted in a display area and has an upwardly extending pedestal. A mounting device is provided, for removably mounting the item on the pedestal to permit inspection of the item. The mounting device has a fastener for preventing its removal from the item. At least one security cable is attached to the retail item and mounting device at one end and is securely mounted at its other end at a point remote from the display area. Potential customers have access to relatively free movement of the retail item without being able to remove the retail item from the display.

5 Claims, 2 Drawing Sheets

SECURITY AND DISPLAY SYSTEM

FIELD OF THE INVENTION

The present invention relates to a security and display system for use with retail items such as cameras, video cameras and recorders and the like. More particularly, the present invention provides an opportunity for potential customers to have relatively free access to the retail item without being able to remove the retail item from the display entirely.

BACKGROUND OF THE INVENTION

In recent times, the rise of retail theft has increased significantly particularly in expensive retail items such as cameras, video cameras and recorders and the like. For this reason, items of that type have been placed in displays where access to the product is limited.

This security display policy is not a problem for persons who know what they want to purchase and are merely looking for the best bargain and may wish to compare features on various models. Those persons can find a retail clerk and obtain access to the product, perhaps even with some instructions from the clerk. However, a significant portion of retail establishment sales are based upon impulse purchases, or at the least, by stimulating latent desires or needs by an attractive and effective display. Impulse sales are not likely to take place with any frequency for items costing up to one thousand dollars or more unless the potential customer can pick up the device, feel, touch and otherwise examine it and begin to form an image in his or her mind where the retail item would be in use.

The alternative, leaving the item on a display and unattended, is totally unacceptable in todays retail environment. Theft is a significant problem and margins of profit do not permit the loss of any significant number of expensive items such as cameras and the like. The ideal situation, with customer access to the product and maximum security has heretofore only been possible when a sales clerk is physically present at the display. Even then, if the clerk is distracted by one customer, other customers are then in a position of examining unattended merchandise. At the least, that is an unnecessary temptation.

There have been methods attempted to display and secure retail items. For example, U.S. Pat. 4,598,827, describes a mechanical security device for clothing in which a plurality of cables are attached at one end to individual items of merchandise, such as clothing, and at the other end to a security mechanism. Systems described in this patent are primarily intended for garment display and security. The invention permits a person to select a garment from a rack of clothing, try on the garment and reach the point of a decision to purchase a specific garment from the rack. This system has been successful in increasing so-called impulse sales for clothing. This security system has not been found to be effective for use with cameras and video equipment, however, because no method for attaching an individual cable to the camera and the like has been proposed which does not require alteration of the camera. Moreover, while this system is effective for garments which hang on hangers, it does not provide any method for displaying cameras or fragile equipment in an attractive manner.

Another system which has been found to be effective for both security and display of clothing is described in U.S. Pat. No. 4,620,182. In this system, an alarm mechanism is employed for signalling a closed circuit condition, such as when the cable which mechanically connects the retail item to the security device is cut. Again, this system has been admirably effective in securing garments and retail items which already have a method for displaying them, but does not provide for any method of displaying products.

Accordingly, it is an object of this invention to provide a display and security system for objects such as cameras, video cameras, video recorders and other such objects.

Another object of this invention is to provide a display and security system for objects which are best marketed by being held in the hand of the potential customer and which are either too expensive or too delicate to be left on a counter top.

Still another object of the present invention is to provide a security system which is simple and easy to attach to cameras and other similar equipment without modifying the product in any way.

Yet another object of the present invention is to provide a security system in which the security portion is attached to cameras and the like in a manner which is easily removed by the store salesperson but which denies removal by customers and other casual observers. Other objects will appear hereinafter.

SUMMARY OF THE INVENTION

It has now been discovered that the above and other objects of the present invention may be accomplished in the following manner. Specifically, an improved security and display device for use with retail items such as cameras has been discovered. The invention is particularly useful for those devices such as cameras, video equipment and the like which have a threaded bore. Typically, those threaded bores are used with tripods or other equipment which may be attached to the bottom of the retail item.

The system of the present invention includes a base for supporting the item, such that it may be displayed in an attractive and pleasing manner. The base is fixedly mounted on a display area and has an upwardly extending pedestal. The system also includes a mounting means for removably mounting the item on the pedestal to permit inspection of the item. The mounting means includes fastening means for fastening the mounting means to the item, such as a threaded bolt which mates with the threaded bore on the camera or other retail item.

Also included is at least one elongated flexible cable fastened at one end to the mounting means or to the object itself and at its other end to a fixture which is inaccessible from the display area. Typically, the one or more cables pass through a small opening in the display counter to a fixture which cannot be accessed without disassembly of the display table itself. Such activity would create sufficient attention to alert store personnel.

In a preferred embodiment, at least one cable is attached to the mounting means and at the other end to a security device, so that this cable is strictly a mechanical security system. In addition, it is preferred that another cable be attached to the object itself, such as to the side of the video camera video recorder or the like and at the other end to an electronic system containing an alarm. The cable for this embodiment should be sensitive to security intrusion in order to actuate the electronic alarm system to which it is connected.

The preferred mounting device for mounting the retail item on the pedestal includes a bolt which is threaded for attachment to a threaded bore in the retail item. By tightening this bolt, the mounting means is firmly attached to the camera. A slot in the terminal end of the mounting device which abuts against the camera may be provided to permit attachment of a cable having an enlarged spherical locking element or cable ball on the attachment end so that the cable cannot be pulled from the mounting device.

In a preferred embodiment, the bolt which is used to attach the mounting device to a camera or other retail item can be turned or loosened only with a specially designed tool, in order to prevent removal of the mounting device by potential customers. A polygonal bore is made in the face of the bolt, similar to those used in conjunction with what are conventionally known as "Allen wrenches". The bore of this embodiment, however, additionally contains an axially centered cylindrical pin extending from the bottom of the polygonal bore to the terminal end of the bolt so that the terminal end of the cylindrical pin is substantially coplanar with the surface of the bolt. This cylindrical pin prevents insertion of a conventional Allen wrench. This embodiment further contemplates the use of a special Allen wrench which is not only sized with the proper polygonal outer shape to conform to the bolt, but is also provided with a cylindrical hold sized to mate with the cylindrical pin. Thus, this special tool is capable of engaging the surfaces of the polygon and permit tightening and loosening of the bolt mounting device to the camera or other retail item.

In yet another preferred embodiment, the bolt is attached to the mounting device by passing the bolt through an opening in the mounting device so that the threads are facing the threaded bore of the retail item. The mounting device contains a restraining pin or other means to resist or prevent removal of the threaded bolt once it has been inserted into the mounting device.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
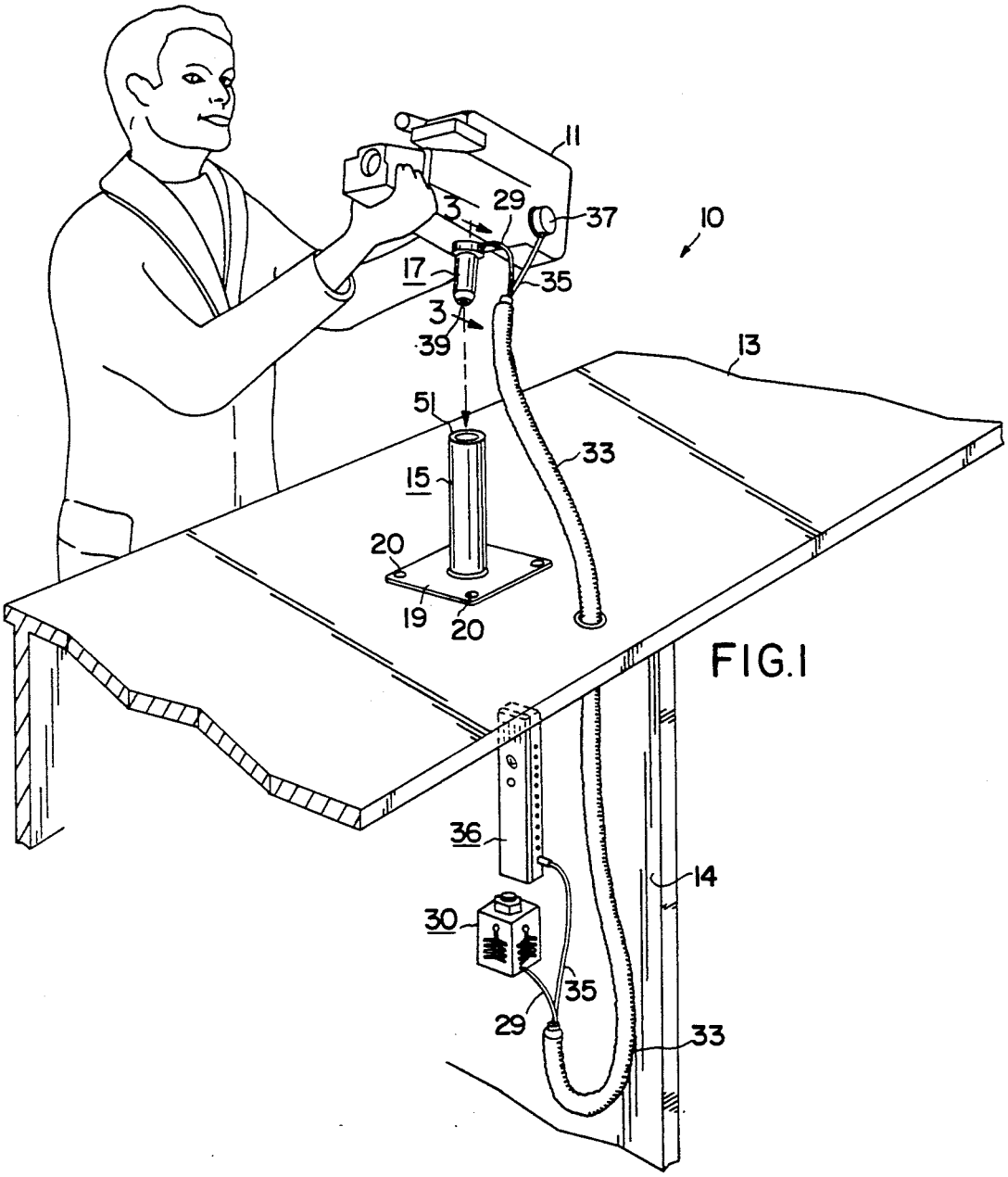
FIG. 1 is a perspective view illustrating the display and security system of the present invention, in use by a potential customer.

The security on display system of the present invention, for use with retail items such as cameras, video camera recorders and the like is shown in FIG. 1 and is generally referred to by the reference numeral 10. In this embodiment, a video camera recorder 11 is shown while be examined by a potential customer. The camera 11 has been displayed on display counter 13 in a typical retail establishment.

Mounted on the display counter 13 is a pedestal 15 for holding the camera 11 when it is on display. Camera 11 has a mounting device 17 attached to it such that the mounting device 17 fits into pedestal 15. Thus, when the potential customer wishes to inspect the camera 11, it is only necessary to lift camera 11 out of pedestal 15.

The pedestal 15 is attached using a base 19 and fasteners 20 to the display counter 13. Base 19 is sized to adequately support the weight and balance of various sized retail items.

Figure 2:
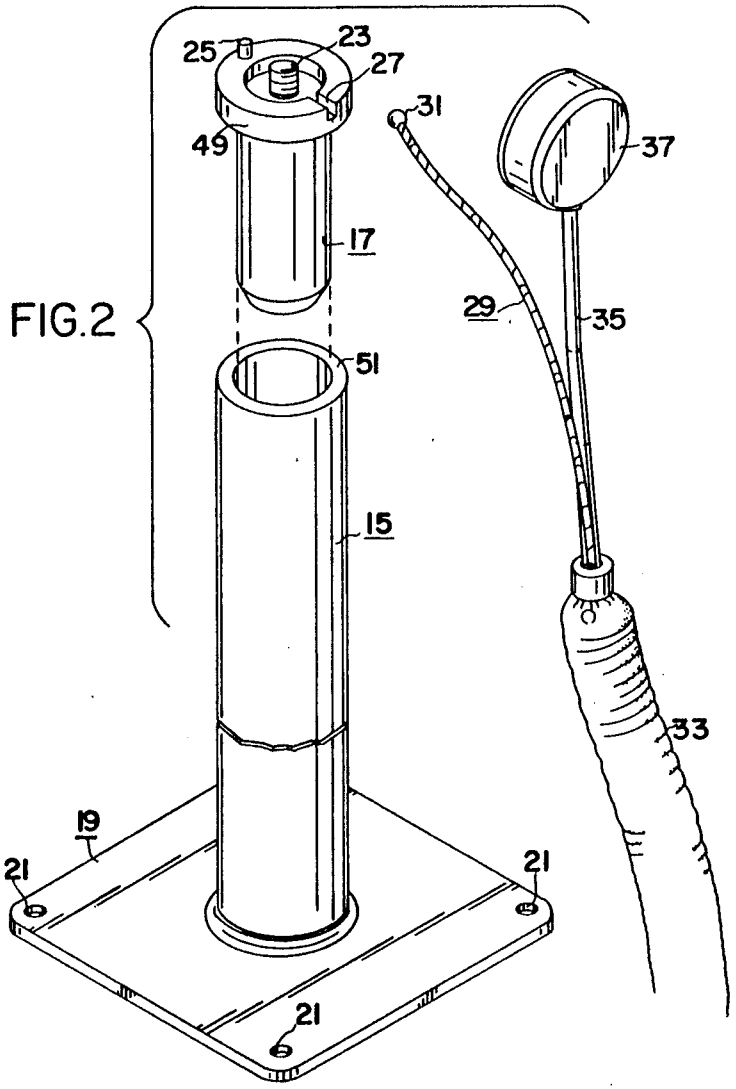
FIG. 2 is an enlarged, exploded, perspective view of the preferred embodiment of the present invention, shown in use with a mechanical security system and an electronic alarm security system.

Turning now to FIG. 2, it can be seen that holes 21 are provided in the base 19 of pedestal 15 so that fasteners 20 can be attached through the table 13 and secured from the underside of table 13 to prevent tampering with the pedestal 15 and base 19.

Mounting device 17 is attached to camera 11 or other retail item by a threaded bolt 23 which extends out of the mounting device 17. Also extending out from the mounting device is an alignment pin 25 which interacts with alignment holes which are typically found on cameras and the like for mounting tripods. As will be apparent herein below, mounting pin 25 prevents rotation of the mounting device 17 to thereby prevent undesired removal of the device 17 from the camera 11.

The camera engaging end of mounting device 17 also includes a slot 27 to provide for attachment of a security device. Shown in FIG. 2 is an elongated cable 29 which fits easily in slot 27 and which has an enlarged spherical locking element or cable ball 31 on its terminal end. The space between the bolt 23 and the slot 27 is sufficient to accommodate the enlarged cable ball 31 and prevent pulling cable 29 away from mounting device 17. The other end of elongated cable 29 is attached to a locking security device 30 which is mounted on the underside 14 of display table 13. Particularly preferred is the security device described in previously identified U.S. Pat. No. 4,598,827, the disclosure of which is incorporated herein by reference. In that system as shown in FIG. 1 herein, the end of cable 29 away from the camera 11 is secured in a locking device 30 where it cannot be removed without having access to the lock.

Cable 29 extends through the display table 13 and may optionally be enclosed in a wire loom sheath 33 or other tube which is attractive. The sheath 33 should not detract from the flexibility of the cable, but permit the camera 11 to be examined with relatively complete freedom by the customer.

Also contained in sheath 33 is a second cable 35. Cable 35 forms part of an electronic security device in which a switching device 37 is attached to the camera 11 as shown in FIG. 1. The switching device 37 is electronically connected to a power source at one end. The power source is contained in an alarm system 36 shown in FIG. 1 to be attached to the display counter support surface 14 and is inaccessible to the customer.

In one embodiment, the alarm system 36 is of the type described in previously mentioned U.S. Pat. No.

4,620,182. The disclosure of that patent is also incorporated herein by reference. In that system, the cable 35 contains a pair of conductive elements in a coaxial cable, such as COLUMBIA FLEX FOAM 1359, manufactured by Columbia Electronic Cables of Pawtucket, Rhode Island. As is described in U.S. Pat. No. 4,620,182, any attempt to cut or otherwise remove cable 35 or switching device 37 causes completion of an electronic circuit which then activates an alarm. The switching device 37 is attached by an adhesive to the camera 11 and will activate the alarm if the adhesive is removed while the alarm system is turned on.

Typically, cameras on display are used only for display, and purchases are made of retail items from inventory and are still in the manufacturer's shipping and display cartons. However, if the camera 11 is to be sold, switch 37 can be disengaged by store personnel after turning off the alarm system 36.

It can be seen that a security system is provided which gives mechanical security through cable 29 and electronic security and alarm through cable 35. At the same time, the potential customer has complete freedom to examine the retail item at his or her leisure.

Figure 3:
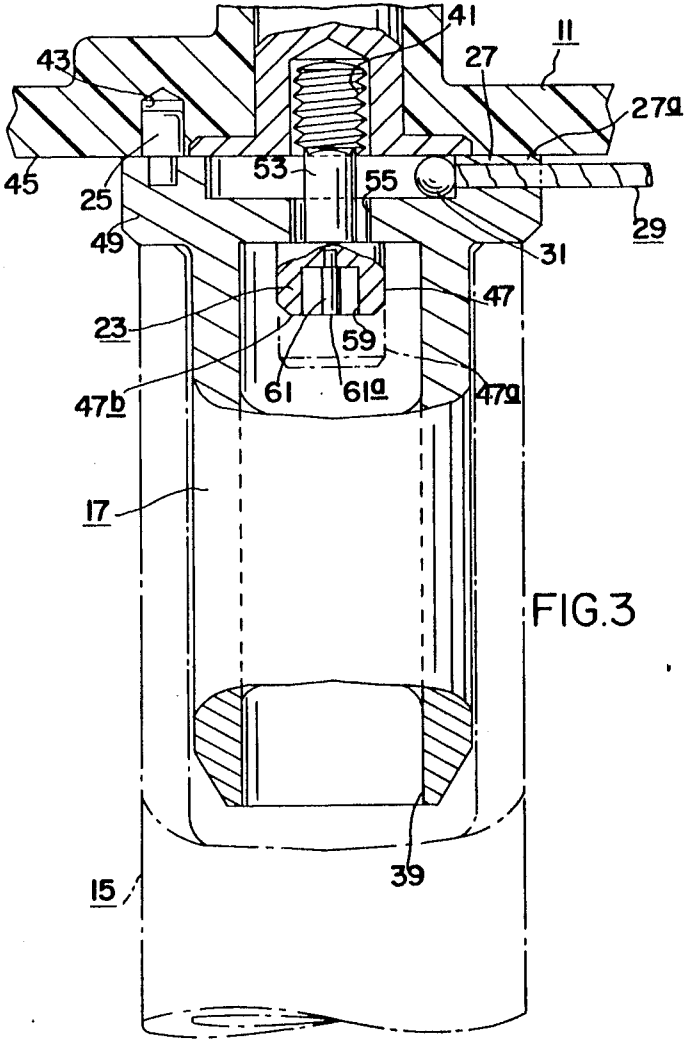
FIG. 3 is a greatly enlarged fragmentary sectional elevational view taken along line 3—3 of FIG. 1, showing the preferred embodiment of the present invention. Also shown in dot and dash outline is the upper terminal end of that portion of the system which holds the mounting device when the retail item is display.

The mounting device 17 of the present invention includes several features which add to the security of the system. Turning now to FIG. 3, the relationship between the camera 11 and the pedestal 15 can be seen. The mounting device 17 is attached to the former and rests comfortably in the latter. The mounting device 17 is attached to camera 11 by threaded bolt 23 which can be accessed through the center hole 39 in mounting device 17. The threaded bolt 23 screws into threaded mounting hole 41 in camera 11. Typically, cameras and other video devices contain holes of this type for mounting tripods and other attachments to the camera. Threads on bolt 23 are sized to accommodate these fittings.

Cameras also have alignment holes 43 and it is intended that the alignment pin 25 of the mounting device 17 extend into hole 43. Thus, pin 25 and hole 43 cooperatively prevent turning the mounting device 17 with respect to the camera 11, thereby preventing it from simply being unscrewed by someone wishing to defeat the security of the system.

When the mounting device 17 is attached to camera 11, the head 47 of bolt 23 pulls the face 45 of camera 11 up against flange 49. Flange 49 is the camera engaging end of mounting device 17 and includes the previously described slot 27. Elongated cable 29 rests in slot 27, with a slight amount of clearance **27*a*, but not enough clearance to permit the enlarged spherical locking ball 31 from passing between the bottom face 45 of camera 11 and the flange 49 into which slot 27 has been cut. Accordingly, as long as bolt 23 is tightened into fitted mounting hole 41, cable 29 remains firmly and securely attached to camera 11**.

When the object is on display, the top portion of pedestal 15 provides a shoulder 51 which supports the flange 49 of mounting device 17. The depth of mounting device 17 is sufficient to prevent the camera from inadvertently falling or being dislodged if it were to be bumped by an inattentive potential consumer. Yet it is easy to remove the camera 11 and mounting device 17 from the pedestal 15.

Mounting device 17 also includes a central shaft portion 53 which connects the threaded end of bolt 23 to the bolt head 47. Central shaft 53 passes through bore 55 in the flange 49 and is loosely fitted so that the larger threads 23 can be put through flange 49 for engagement into camera mounting hole 41. As long as the threaded bolt is not unscrewed, it will remain secure in threaded mounting hole 41 and the mounting device 17 and any security cables 29 and the like will remain in tact. However, at times when it is desirable by the retail establishment to change cameras 11, the threaded bolt 23 can be removed from the camera. An "O-ring", not shown, can be used to prevent the threaded bolt 23 from falling through bore 55, and potentially being lost or misplaced.

Of primary importance in any security device is the requirement that the mounting device or other security means be as tamper proof as possible when it is attached to the retail item being secured and displayed. In a preferred embodiment, the threaded bolt 23 is attached to the camera 11 in threaded mounting hole 41 by rotating the bolt head 47 and screwing the mounting device onto the camera face 45 as it moves from the dot dash location shown by reference numeral **47*a* to the firmly attached position 47 in FIG. 3**.

The fastener preferably is operable only using a non-conventional attachment means. In order to prevent disassemblement by a potential shoplifter, such as by the use of a screw driver or other tool, bolt head 47 contains a hexagonal bore 59 of the type conventionally known as an Allen wrench slot or bore. Also contained in bore 59 is an axially centered cylindrical pin 61 whose terminal end **61*a* is coplanar with the terminal end 47*b* of bolt head 47. Thus, a typical Allen wrench cannot be inserted into bore 59** to engage with the polygonal surfaces. Other non-conventional fasteners such as an off-sized Allen wrench and bore combinations, or unusual screw heads with special screw drivers, can be used.

Figure 4:
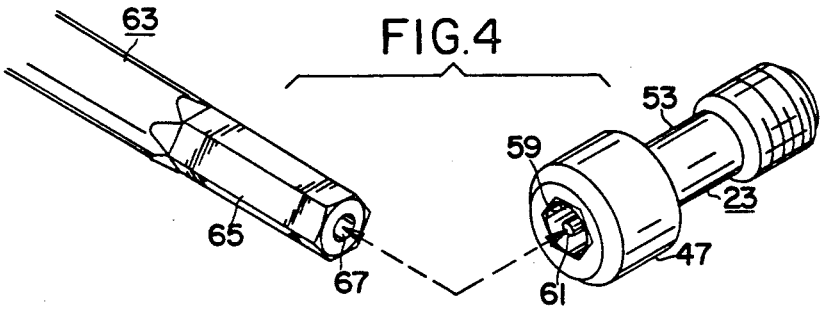
FIG. 4 is an enlarged, isometric view of both the mounting bolt used with the mounting device and the terminal end of a modified Allen wrench used to join and disassemble the mounting bolt from the retail item.

Turning now to FIG. 4, the preferred special tool 63 is shown ready for use with bolt 47. Special locking tool 63 includes an Allen wrench end 65, hexagonal in shape to correspond with the bore 59 of bolt head 47. The tool 63 also includes a cylindrical hole 67 which is sized to mate with cylindrical pin 61. Thus, in order to insert the tool 63 into the bolt head 47, it is necessary to align the hexagonal bore 59 with the hexagonal shaft head 65. It is also necessary to align cylindrical pin 61 with hole 67. While no security system is one hundred percent secure, it is unlikely that the any shoplifter will carry a tool such as wrench 63 since these are not commercially available and since both bore 59 and shaft 65 can be of an unusual size and configuration. Accordingly, removal of the bolts 23 from the camera 11 to detach mounting device 17 can only be done by the retailer personnel.

In order to demonstrate the efficacy of the present invention, a display of video cameras and video recorders was fitted with the present invention. Not only were there no thefts or disappearances of the equipment, sales increased by twenty-two percent (22%) over a comparable time period. Store personnel stated that the increase in sales was due to increased impulse buying when customers were able to handle the equipment.

While the invention is susceptible to various modifications and alternative forms, a specific embodiment has been shown and described herein. It is to be understood, however, that it is not intended to limit the invention to the particular embodiments disclosed herein. On the contrary, the intention is to cover all modifications, equivalents and alternatives falling within the spirit and scope of the invention as defined by the appended claims.

What is claimed is:

1. A security and display system for use with a retail item having a threaded bore, comprising:

a base for supporting said item in a display area and having an upwardly extending pedestal having a central bore;

mounting means including a shaft member sized to fit said central bore for removably mounting said item cooperatively in said central bore of said pedestal to permit inspection of said item;

fastening means for locking said shaft member to said item;

said fastening means including an elongated bolt member having a threaded end engageable in said threaded bore in said retail item;

means defining a socket with an elongated pin centered in said socket generally centrally thereof whereby the fastening means may be rotated to assemble and disassemble by means of a tool having an exterior surface complementing said socket and said pin;

a pair of security cables attached to said item and mounting means at one end and securely mounted at its other end at a point remote from the display area, one of said cables being a mechanical security cable attached at one end to said item by said mounting means and the other of said cables being an electronic security cable attached to said item, whereby potential customers have access to relatively free movement of the retail item with the item removed from said pedestal.

2. A system as claimed in claim 1, wherein said socket is of hexagonal cross section and said pin is of a circular cross section.

3. A system as claimed in claim 1 wherein the axial length of said fastening means is substantially less than the axial length of said shaft member so that the inner terminal end is spaced inwardly a predetermined distance from the open outer terminal end of said shaft member.

4. A system as claimed in claim 1 including an alignment pin engaging in an opening in the inner axial end face of said shaft member and the surface of said retail item which it confronts.

5. A system as claimed in claim 1 including a wrench of a predetermined cross section complementing the socket and pin of said fastening means for assembly and disassembly of said fastening means.

* * * * *